US009151559B2

(12) United States Patent
Alicea, Jr.

(10) Patent No.: US 9,151,559 B2
(45) Date of Patent: Oct. 6, 2015

(54) DIGITAL HYBRID FIREARM

(71) Applicant: Benjamin Alicea, Jr., Oldsmar, FL (US)

(72) Inventor: Benjamin Alicea, Jr., Oldsmar, FL (US)

( * ) Notice: Subject to any disclaimer, the term of this patent is extended or adjusted under 35 U.S.C. 154(b) by 0 days.

(21) Appl. No.: 14/332,667

(22) Filed: Jul. 16, 2014

(65) Prior Publication Data

US 2015/0241156 A1 Aug. 27, 2015

Related U.S. Application Data

(63) Continuation of application No. 13/474,587, filed on May 17, 2012, now Pat. No. 8,807,007.

(60) Provisional application No. 61/486,935, filed on May 17, 2011, provisional application No. 61/593,432, filed on Feb. 1, 2012.

(51) Int. Cl.
*F41A 19/59* (2006.01)
*F41A 19/69* (2006.01)

(52) U.S. Cl.
CPC ..... *F41A 19/59* (2013.01); *F41A 19/69* (2013.01)

(58) Field of Classification Search
CPC ..... F41A 17/06; F41A 19/06; F41A 19/58–19/59; F41A 19/69
USPC ..... 42/42.03, 69.01–69.03; 89/132, 142, 89/148, 28.1
See application file for complete search history.

(56) References Cited

U.S. PATENT DOCUMENTS

| | | | |
|---|---|---|---|
| 2,780,882 | A | 2/1957 | Temple |
| 3,045,555 | A | 7/1962 | Stoner |
| 4,727,670 | A | 3/1988 | Krouse |
| 4,793,085 | A | 12/1988 | Surawski et al. |
| 5,713,150 | A | 2/1998 | Ealovega |
| 6,412,207 | B1 | 7/2002 | Crye et al. |
| 6,626,165 | B1 | 9/2003 | Bhogal |
| 6,889,682 | B2 | 5/2005 | Styles et al. |
| 6,976,416 | B2 | 12/2005 | Ealovega |
| 7,765,999 | B1 | 8/2010 | Stephens et al. |
| 7,819,051 | B1 | 10/2010 | Beckmann et al. |
| 8,336,438 | B2 | 12/2012 | Compton et al. |
| 2006/0169268 | A1 | 8/2006 | Tippmann |
| 2009/0255160 | A1 | 10/2009 | Summers |
| 2010/0186277 | A1 | 7/2010 | Beckmann |

*Primary Examiner* — Stephen M Johnson
*Assistant Examiner* — Benjamin Gomberg
(74) *Attorney, Agent, or Firm* — Taft Stettinius & Hollister LLP

(57) ABSTRACT

A firearm for mechanically and electronically firing a weapon including a trigger rotatably mounted to a sear and having an actuator attached thereto. A secondary sear is rotatably mounted to the sear, and a switch is mounted to the lower receiver behind the trigger and adapted to be contacted by the actuator when the trigger is pulled. An electronic circuit is electrically connected to the switch such that when the switch is contacted the circuit is energized to operate a prime mover that operates the firearm. The sear assembly may also comprise a main sear and an auxiliary sear controlled by a selector switch having cam surfaces and adapted to be rotated to a plurality of positions, wherein in a first position comprises a safety mode, a second position comprises a mechanical mode of fire and a third position comprises an electronic mode of fire.

15 Claims, 7 Drawing Sheets

DIGITAL HYBRID FIREARM

CROSS-REFERENCE TO RELATED APPLICATIONS

The present application is a continuation of U.S. patent application Ser. No. 13/474,587 filed on May 17, 2012, which claims the benefit of the filing date of U.S. Provisional Patent Application Ser. No. 61/486,935, filed on May 17, 2011, and also claims the benefit of the filing date of U.S. Provisional Patent Application Ser. No. 61/593,432, filed on Feb. 1, 2012. The contents of said applications are incorporated herein by reference.

BACKGROUND OF THE INVENTION

Predominantly firearms with multiple firing modes are used only in military applications and firearms that are currently available that have more than one firing mode are strictly mechanical in nature. Mechanical systems have been relied upon by the military because they are very reliable and because in a military setting a malfunctioning weapon can mean the difference between life and death. Present mechanical systems have been well-refined and rarely fail.

However, when introducing additional firing modes, the resulting mechanics do become more complex. System complexities are compounding—a fully automatic weapon is more complex and has more moving parts than a semi-automatic weapon which in turn has more moving parts than a non-autoloading weapon. A fully automatic weapon that has multiple modes of firing is yet more mechanically complex a standard fully automatic weapon. And thus, in addition to the compounding of mechanical complexity of assembly, maintenance and repair, there exists greater number of parts that can wear and will eventually fail.

Any assault or military style weapon must at the very least have a semi-automatic mode of fire. However, most weapons, in addition to semi-automatic mode of fire, have a fully automatic mode of fire and a burst mode of fire. These modes allow a soldier to have some choices on the battle field. Despite the availability of multiple modes of fire in a mechanical package, the modes themselves have limits. Full automatic mode can be problematic because soldiers have the ability to completely empty their weapon of ammunition in a moment of panic. Also limiting, is that once a gun has been timed, it is impossible to adjust the automatic rate of fire.

Also of note, due to the complexities of burst mechanisms, there is not a firearm in existence with more than two burst modes.

A helpful improvement to automatic weapons was the burst mode of fire. In this mode, a single squeeze of the trigger will cause the gun to fire a predetermined number of rounds, usually three, at a time. This has the added benefit of providing a limited automatic firing mode but prevents the soldier from emptying his weapon of ammunition in a moment of panic or poor decision-making which can easily occur in the heat of battle. The limitation, however, with mechanical burst mode is that that not only can the rate of fire still not be controlled, but the burst mechanism is complex and, as soldiers have reported, is prone to rapid wear. Moreover, the number of rounds fired in mechanical weapon having burst mode cannot easily be manipulated in the field to fit the exigencies of the situation or to mislead the enemy.

Despite these shortcomings of mechanical systems, the unreliability of an electronic system has prevented militaries from arming their soldiers with non-mechanical systems.

This is primarily due to reluctance to rely on weapons that require batteries or that do not perform properly when wet or even submersed in water.

In non-military settings, electronic systems for firing weapons have been previously developed, and these systems have typically entirely replaced the mechanical components of the weapon except the trigger itself. For example, electronic systems have replaced mechanical triggers in some competition target shooting weapons because it is widely believed that the physical movement of such mechanical systems can affect the shooters aim. Also, these firearms typically not engineered to be capable of multi-modes of firing for the reasons that competition target shooting typically does not require more than a single shot mode of firing, many shooting ranges discourage rapid-fire shooting for reasons of safety, and that in the United States and many other countries it is illegal for most private citizens to possess automatically repeating firearms with a special license or permit.

Paintball guns, which are not true firearms, have also utilized electronic triggers in place of mechanical triggers. Paintball guns are not true firearms because the common definition of "firearm" requires the weapon to ignite gunpowder to fire a projectile and paintball guns use compressed air. As a result, a paintball gun does not use any of the same mechanical parts, such as a hammer or sear, to fire a projectile, and instead uses a trigger actuated valve that allows a controlled release of compressed air from an air storage reservoir to launch a projectile. Regardless, some paintball guns have replaced mechanical actuated valving with electrically actuated valving because rapid fire is beneficial to paintball games and possessing an automatically firing paintball gun is not illegal in the United States or most (if not all) countries. However, reliability in the paintball art is not such great concern as in military and failures are more acceptable. Though it is doubtful that electric paintball mechanisms used to launch a ball of paint with air could be adapted to a firearm used to ignite gunpowder to fire a bullet, such systems would still be insufficient.

Finally, weapons that attempt to mechanically operate a trigger, such as mounted to a gun to actuate a trigger, have been invented. Such devices do not work well and are unreliable. Such devices more resemble silly gimmicks and have been soundly rejected in nearly all, including military, applications. Moreover, these devices, when mounted to a gun, typically prevent the usage of a trigger by a user's finger and require some other means of actuation that make the gun more dangerous to operate and accurately fire.

One attempt at an electronically-controlled firearm is disclosed in U.S. Pat. No. 5,713,150 to Ealovega. Ealovega uses a piezo-electrically actuated sear to control, after an initial trigger pull, the hammer action of the gun. As the shooter holds down the trigger, an electronic switch (96) sends a signal to the piezoelectric member (62) to trip the piezoelectrically actuated sear and thus fire the weapon. Therefore, Ealovega uses a piezoelectric device in place of a known mechanical device to create an automatic firing mode. As a result, the weapon of Ealovega cannot be fired initially in an electronic mode but must be manually fired with an initial mechanical trigger pull. Therefore, the first pull of Ealovega requires a manual trigger pull which negatively affects shooter aim.

Another problem with Ealovega, is the addition of additional moving parts instead of the elimination of moving parts. Moreover, the electronic components of Ealovega, and particularly the piezoelectric device, are housed within the lower receiver of the weapon. The lower receiver very rapidly fills up with carbon due to gases which operate the action of the weapon being redirected from the barrel to the lower receiver. Carbon soot is a conductive and corrosive material which tends to short out and corrode electronic components. Moreover, lubricating oil present in the lower receiver to lubricate the many moving parts further exposes electronic components to destructive contaminants.

Therefore, a need exists for an electronic automatic firing weapon with multiple firing modes, and preferably a burst mode, that can control the rate of rounds fired in both burst and automatic mode, number of rounds fired in burst, or to provide additional modes of firing that have the ability to deceive the enemy.

SUMMARY OF THE INVENTION

A firearm for mechanically and electronically firing a weapon including a trigger rotatably mounted to a sear and having an actuator attached thereto. A secondary sear is rotatably mounted to the sear, and a switch is mounted to the lower receiver behind the trigger and adapted to be contacted by the actuator when the trigger is pulled. An electronic circuit is electrically connected to the switch such that when the switch is contacted the circuit is energized to operate a prime mover that operates the firearm. The sear assembly may also comprise a main sear and an auxiliary sear controlled by a selector switch having cam surfaces and adapted to be rotated to a plurality of positions, wherein in a first position comprises a safety mode, a second position comprises a mechanical mode of fire and a third position comprises an electronic mode of fire.

DESCRIPTION OF THE DRAWINGS SHOWING THE PREFERRED EMBODIMENT

DESCRIPTION THE EMBODIMENTS

Described herein will be a preferred embodiment of the invention, but not the only embodiment of the invention. The description below is not intended to be limited of the full concept of the invention. The description below can be varied considerably without departing the inventive aspect of the present invention, and it is impossible for the inventor of the present invention to conceive of every manner in which his invention could be used by others. The claims that follow are intended to be the only limitation on the present invention, which is unique and has far-ranging application beyond the single embodiment described herein.

With the advent of solid state electronics, most mechanical systems have gone from analog to digital. Firearms, however, have remained purely mechanical and for good reason, nobody wants to rely on a gun that can go dead if the batteries do or can fail in wet situations.

The preferred embodiment of the present invention can be utilized in conjunction with existing semi-automatic weaponry designs to provide for a more reliable weapon while providing easy selectivity of the mode of fire and easy adjustment of the features of each mode of fire. In this respect, the present invention actually reduces the complexity of existing fully automatic weapons or weapons incorporating multiple modes of fire. The present invention accomplishes this by providing a trigger actuated electronic mode of fire in parallel with a mechanical, semiautomatic mode of fire that is actuated by the same pull of the same trigger. In this manner, the failure of an electronic system will not prevent a soldier or other firearm user from suffering from a non-working weapon for even a single trigger pull.

Thus the present invention eliminates additional auto sears and bolt releases, and increasingly complex ratcheting drum mechanisms found in burst mechanisms of mechanical automatic firing or burst firing weapons. In the case of a dead battery, or failed electronics, the original mechanical system is still ready as a failsafe.

In addition to the benefit of electronically controlled timing and firing modes, the present invention utilizes an electronic trigger. It is commonly known that pulling the trigger is the most difficult part of shooting accurately. There is with most triggers a "break point" which is the exact point where the sear releases the hammer and the firearm discharges. Applying enough force to a trigger to cause the gun to fire is difficult to do without moving the gun and thereby affecting the shooter's aim. With the present invention, the trigger pull is an electronic function (except in the case of malfunction), and as such, there exists no break point and shooting precision is improved. While care should be taken for the sake of safety not to have too light of a trigger pull, long range shots can now be taken without even the slightest movement of the gun aside from post shot recoil.

Figure 1:
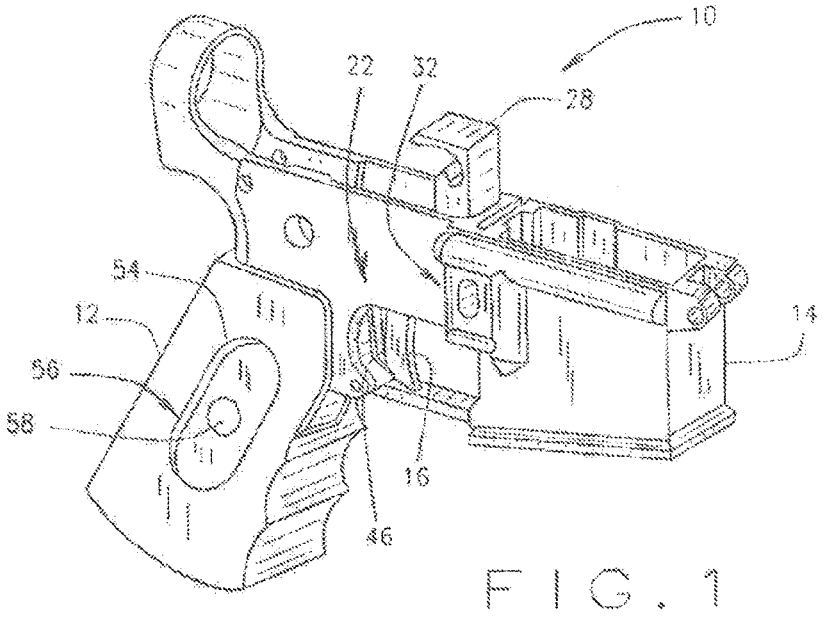
FIG. 1 is a perspective view of a lower receiver assembly and grip of a firearm according to an embodiment of the present invention.
Figure 2:
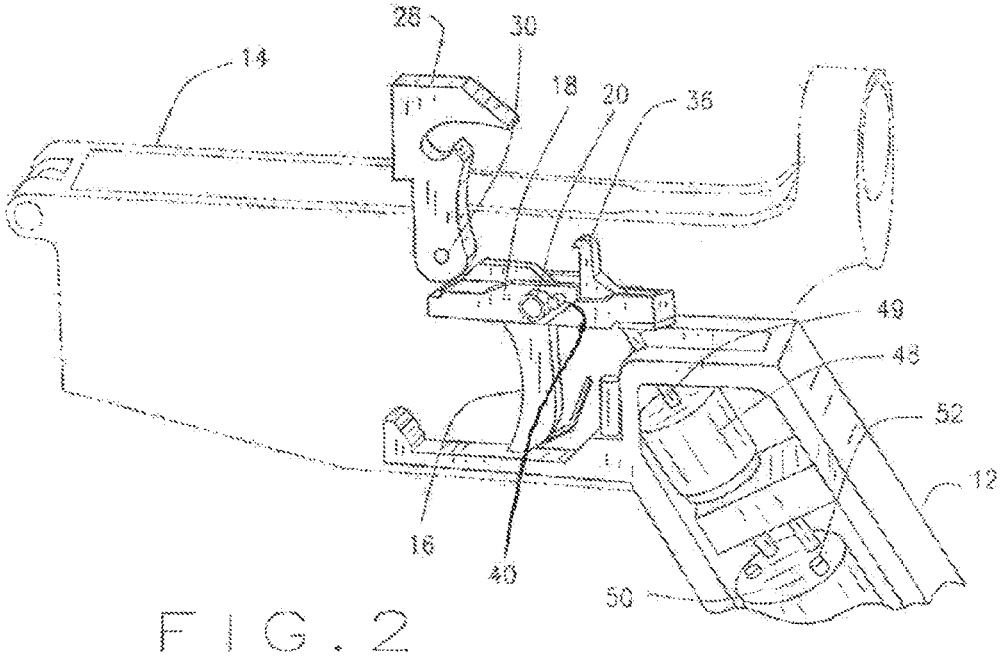
FIG. 2 is a cutaway view of a lower receiver assembly and grip of a firearm according to an embodiment of the present invention.

Referring now to the drawings, FIGS. 1 and 2 show a firearm 10 according to an embodiment of the present invention. For ease of view, the firearm 10 is shown with the barrel, chamber and action removed. The firearm 10 comprises a grip 12 and a lower receiver 14.

Figure 3:
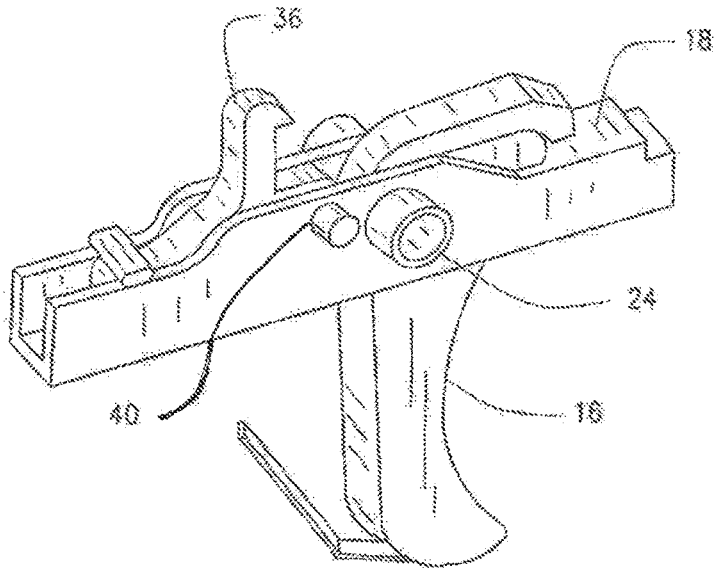
FIG. 3 is an upper perspective view of a trigger, sear and secondary sear according to an embodiment of the present invention.
Figure 4:
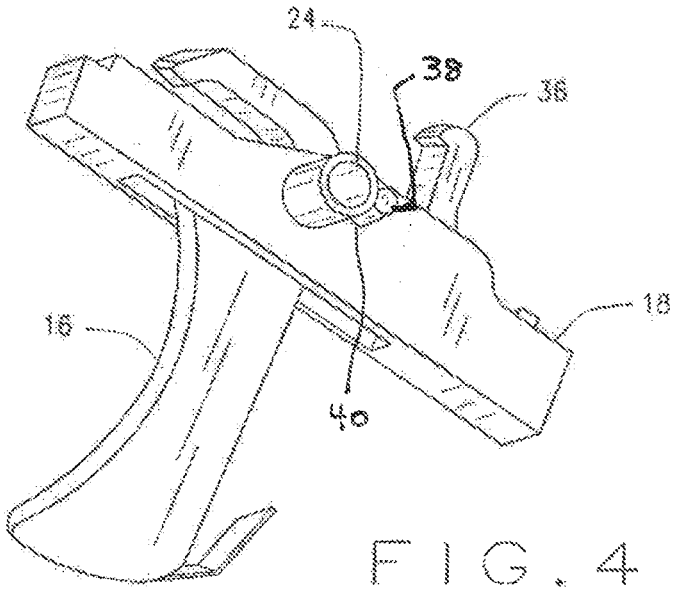
FIG. 4 is a lower perspective view of a trigger, sear and secondary sear according to an embodiment of the present invention.
Figure 5:
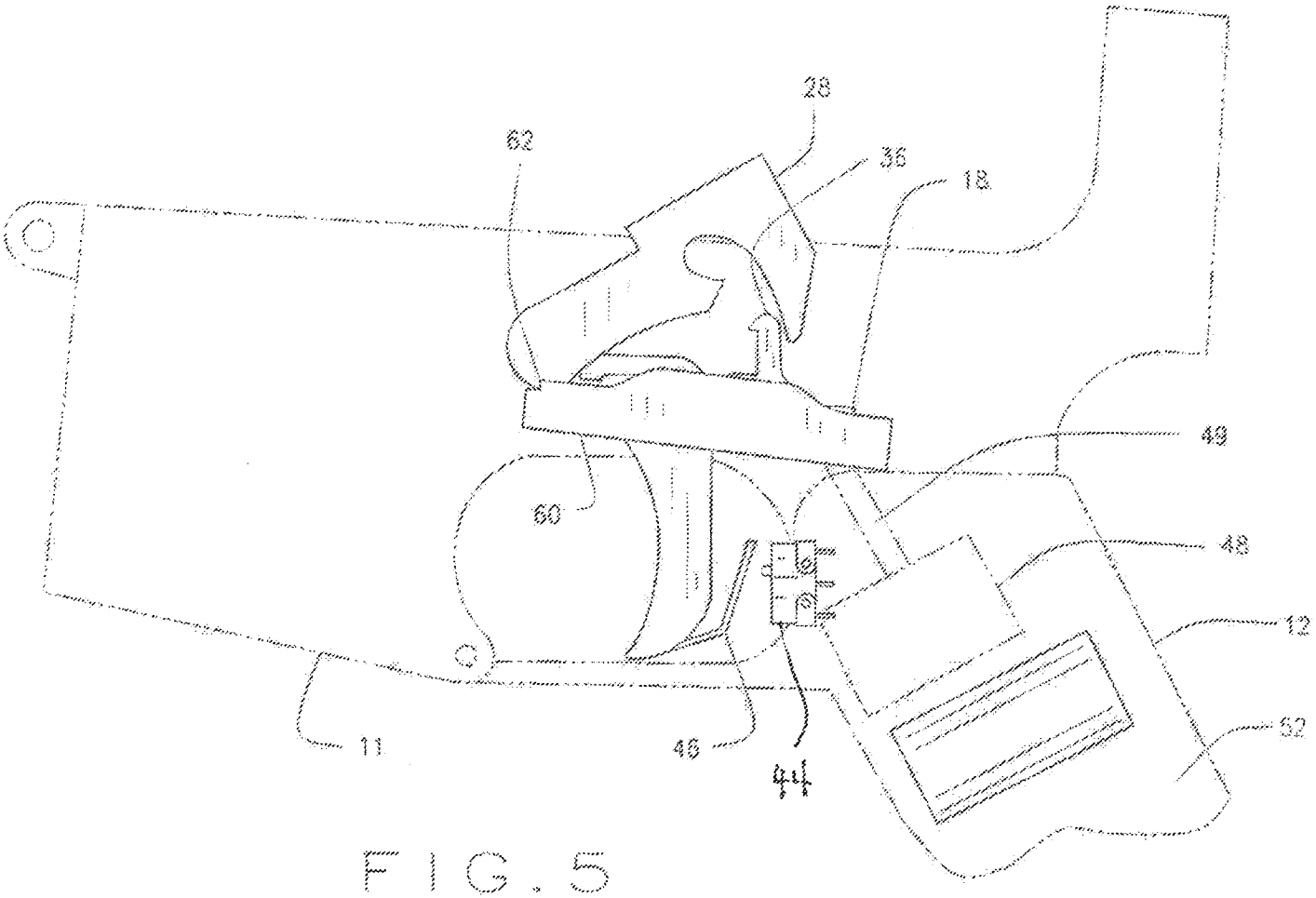
FIG. 5 is an enlarged cutaway view of a lower receiver assembly and grip of a firearm according to an embodiment of the present invention.

Referring now to FIGS. 3, 4 and 5, a trigger 16 is rotatably mounted to a sear 18 and the lower receiver 14 by a trigger pin 20 that extends through a bore 22 (FIG. 1) of the lower receiver 14, a bore 24 of the sear 18 and a bore of the trigger 16. A hammer 28 is also rotatably mounted to the lower receiver 14 by a hammer pin 30 that extends through a bore 32 of the lower receiver 14 and a bore 34 of the hammer pin 30. Finally, a secondary sear 36 is rotatably mounted to the sear 18 by a secondary sear pin 38 that extends through a bore 40 in the sear 18 and a bore 42 in the secondary sear pin 36.

A microswitch 44 is further mounted to the lower receiver 14 directly behind the trigger 16. A flexible switch actuator 46 is mounted to the trigger 16 between the trigger 16 and the microswitch 44 such that when the trigger 16 is pulled rearwardly to fire the firearm 10, the switch actuator 46 contacts the microswitch 44 and causes the microswitch 44 to complete an electrical circuit.

Referring back to FIG. 2, within the grip 12 of the firearm 10 is a solenoid 48 having an actuator 49, a battery 50 and a control circuit 52. Referring yet back to FIG. 1, the grip 12 further includes a plurality of control buttons 54, 56 and 58 that are electrically connected to the control circuit 52 for controlling the selection of the mode of fire of the firearm and also to control the behavior of each mode of fire, as explained in further detail below.

In operation, the cycle begins with the hammer 28 in the position of FIG. 5. An engagement surface 60 of the sear 18 locks with an corresponding engagement surface 62 of the hammer 28 in place to prevent firing of the firearm 10. When the trigger 16 is operated rearwardly such that the switch actuator 46 contacts the microswitch 44 and closes a circuit, the control circuit 52 is signaled that the trigger 16 has been pulled. Nearly instantaneously, the control circuit 52 operates the solenoid 48 to move the actuator 49 toward the sear 18 to rotate the sear 18 about the trigger pin 20. As the sear 18 rotates from the force of the solenoid actuator 49, the sear 18 disengages the hammer 28 and allows the hammer 28 under the force of the pressure of a spring (not shown) to come forward to the position of that shown in FIG. 2 where it strikes a firing pin (not shown). As is known in the art, the action of the firearm 10 then moves rearwardly by redirecting gas pressure from firing of the firearm 10 to force the hammer 28 to return to the position of FIG. 5. As is also known the art, the spent shell is also ejected from the firearm 10 and a new shell is loaded into the chamber. When the hammer 28 is returned to the position of FIG. 5, the hammer 28 is again held in position by the sear 18.

If the shooter continues to hold the switch actuator 46 of the trigger 16 against the microswitch 44, the solenoid 48 will again actuate based upon the firing mode that the control circuit 52 is currently programmed to execute. If, for example, the control circuit 52 is programmed to execute a fully automatic mode of firing with a predetermined time separation between shots, the control circuit 52 will wait the required time period and again execute the solenoid 48 such that the actuator 49 will rotate the sear 18 to allow the hammer 28 to strike the firing pin. This firing mode will continue to operate until the shooter releases the trigger. After the shooter releases the trigger 16, the sear 18 will again hold the hammer 28 in a fixed position when the hammer returns to the position of FIG. 5 until a subsequent trigger 16 pull.

In the event the solenoid 48 would fail to operate when the trigger 16 is pulled, the shooter would instinctively continue to pull the trigger 16 until the sear 18 is manually rotated through the pulling of the trigger 16, as is known in the art. To the shooter, the act of the gun firing mechanically rather than electronically is entirely transparent because the mechanical actuation of the sear 18 happens only milliseconds later than the electronic actuation of the sear would have taken place would have taken place. In this manner, the shooter suffers no lost shot as a result of the failure of the electronic system and need not take any additional action in order to continue firing manual in semiautomatic mode.

The control circuit 52 of the present invention is preferably an energy efficient microprocessor-based control circuit into which many firing modes have been programmed. Moreover, the firing modes are user adjustable through the use of the buttons 54-58 located on the grip 12. Most preferably, the firing modes include at least an automatic firing mode in which the firearm 10 is fired continuously by the solenoid 48 until the trigger 16 is released and a burst mode in which the firearm 10 is fired for a predetermined number of shots while the trigger 16 is pulled and no fires no further shots until the trigger 16 is released and reengaged. Preferably, each of the automatic and burst modes has a user selectable delay-between-shots adjustment to control the speed of fire from very slow to as fast the gun will operate. Also preferably, in the burst mode, the user can select the desired number of rounds to be fired for each trigger pull.

Obviously, an endless number of variations in firing modes could be implemented, including more complex modes that utilize an irregular cadence to confuse the enemy about the number of combatants he is facing, to a simple mode that is merely a standard semi-automatic mode of fire. Moreover, the control circuit 52 can include an "off" mode in which the firearm 10 is allowed to only operate mechanically to conserve the firearm's battery.

Preferably, the battery 50 is a rechargeable lithium-ion type battery that can also be easily removed and replaced in lieu of recharging.

Figure 6:
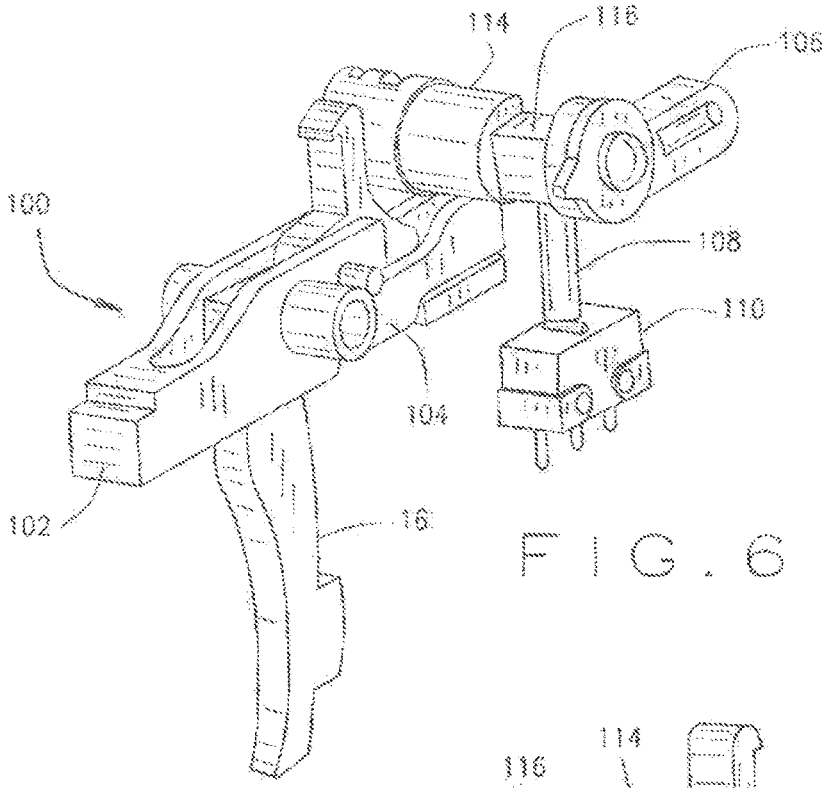
FIG. 6 is a front perspective view of a trigger assembly according to a second embodiment of the invention with the switch in a first position.
Figure 7:
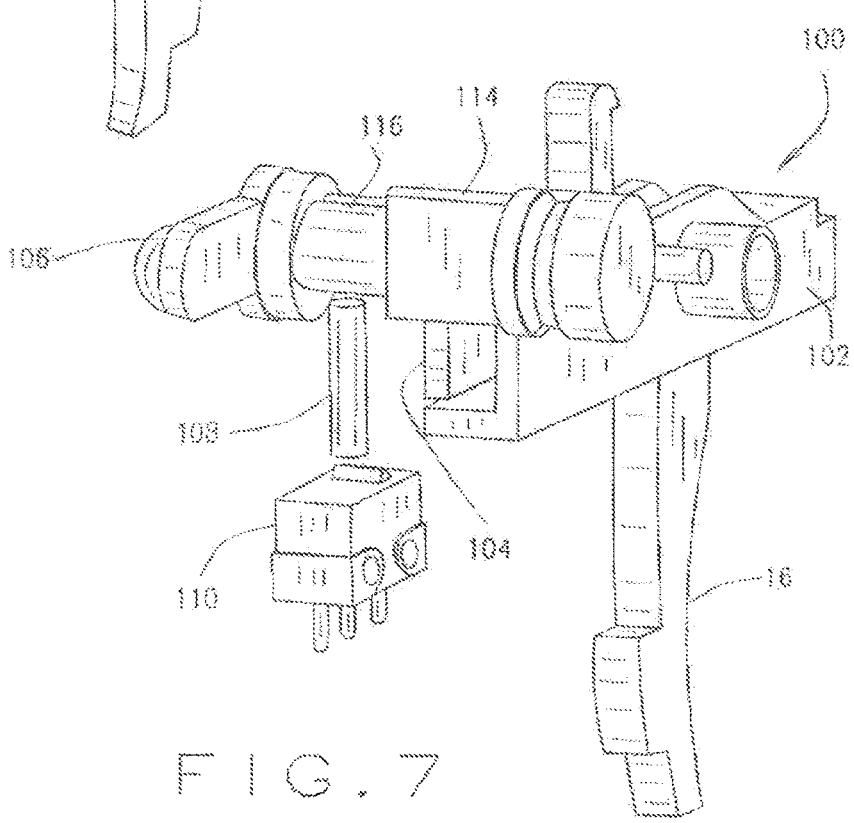
FIG. 7 is a rear perspective view of a trigger assembly according to a second embodiment of the invention with the switch in a first position.
Figure 8:
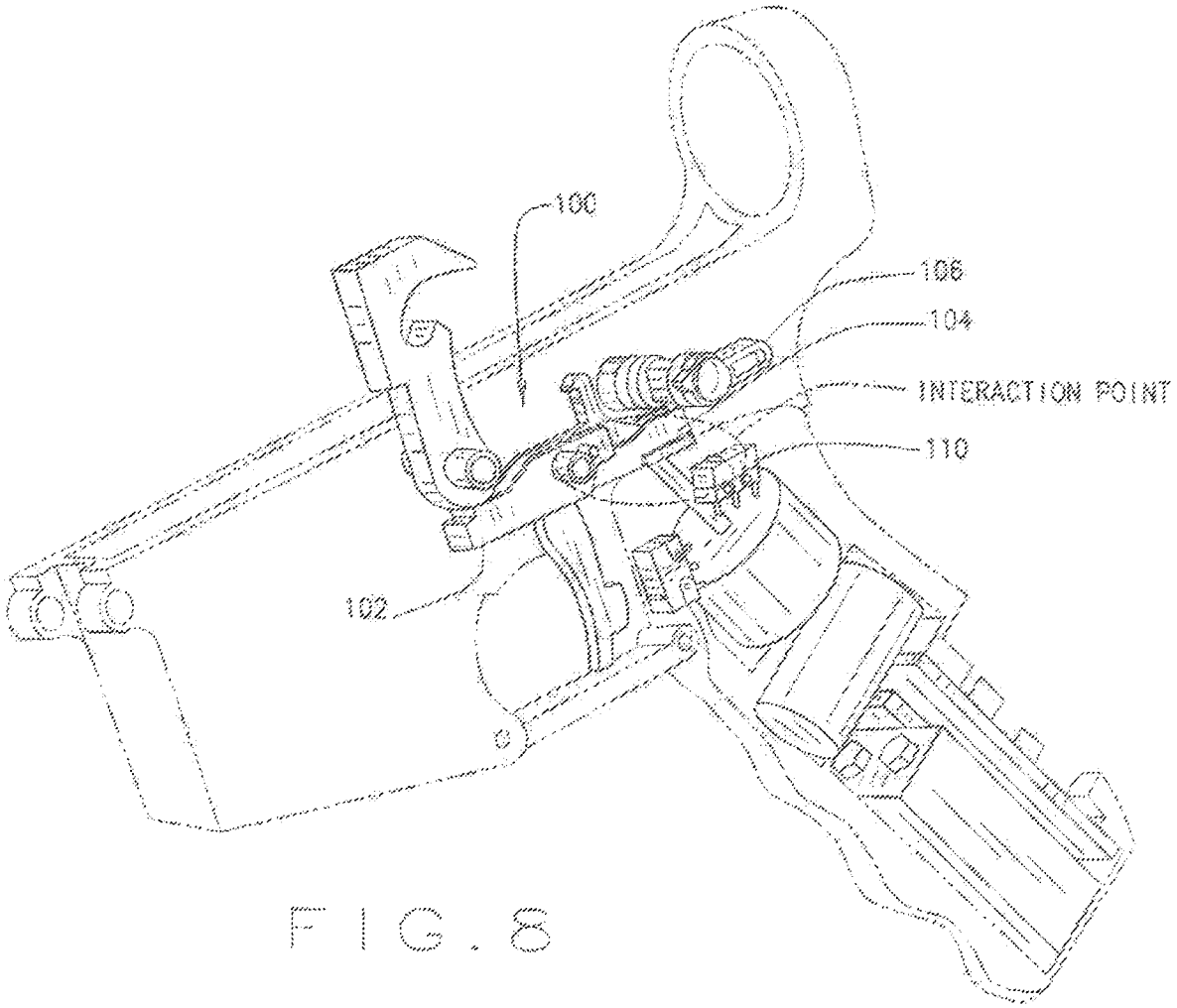
FIG. 8 is a side perspective view of a trigger assembly according to a second embodiment of the invention mounted within a weapon.

In another embodiment of the present invention, the digital trigger invention allows for selective alternative engagement of the mechanical and electronic trigger modes through the use of a split sear system. Referring to FIGS. 6 and 7 of the present invention, the split sear 100 comprises a first portion or main sear 102 and a second portion or auxiliary sear 104 rotatably attached to the first portion 102. A selector cam or switch 106 is mounted above the sear assembly 100. A pushrod 108 is mounted for reciprocal movement within a bore.

The switch 106 comprises two cam surfaces—first surface 114 and second surface 116. The switch 106 may optionally include structure to provide for positive stops in three positions. In each of three positions of the switch 106, the following functionality of the firearm is enabled or disabled. In position 1, the switch 106 disables all firing ability of the weapon, i.e. "safety position." In position 2—to turn on the electronic firing mode, a microswitch 110 is activated or "electronic fire mode." The trigger 16 must not activate the main sear assembly 100, otherwise it will cause the disconnector to catch the hammer 28 and prevent burst/full automatic firing during a continuous pull. In position 3, the switch 106 turns off the electronics by releasing the microswitch 110 and allowing the weapon to fire only mechanically.

In greater detail, in position 1 (FIGS. 6 and 7), the selector switch 106 blocks all movement of the main sear 102 to prevent mechanical firing of the weapon. Further a cammed surface of the second surface 116 releases the pushrod 108 and microswitch 110, such that the electronics of the weapon are deactivated and will not fire the weapon. The first surface 114 prevents mechanical rotation of the main and auxiliary sears 102 and 104.

Figure 9:
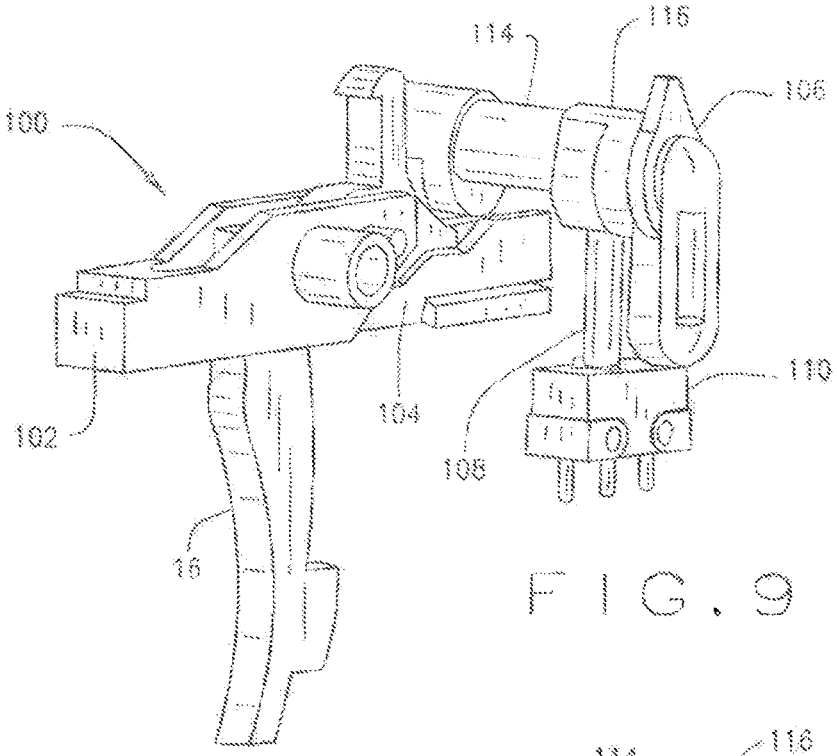
FIG. 9 is a front perspective view of a trigger assembly according to a second embodiment of the invention with the switch in a second position.
Figure 10:
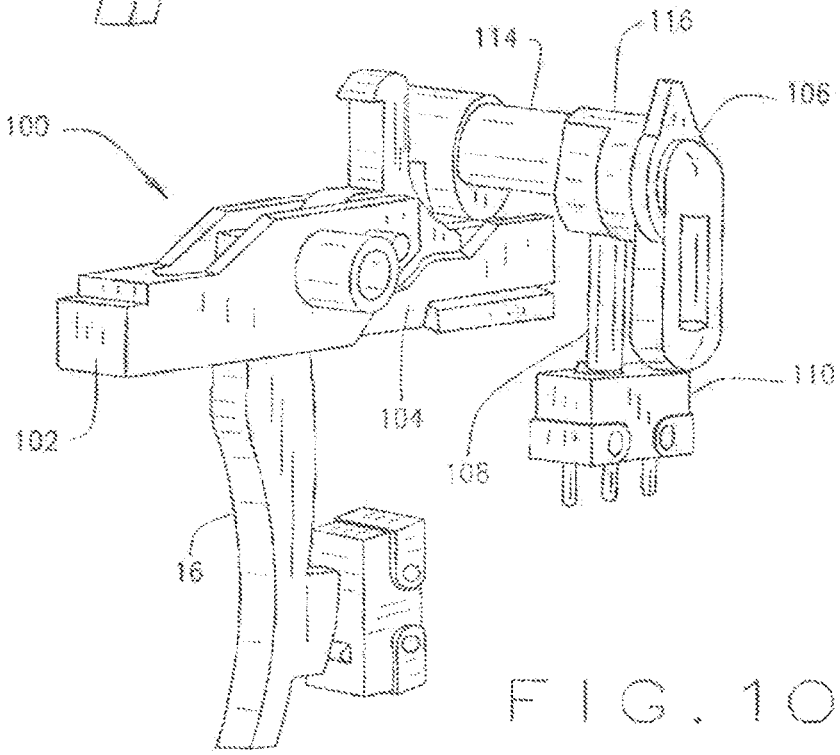
FIG. 10 is a front perspective view of a trigger assembly according to a second embodiment of the invention with the switch in a second position with an auxiliary sear partially rotated.

In position 2 (FIGS. 9 and 10), the switch 106 is rotated so the weapon is in the electronic fire mode. In this position, the second cam 116 surface engages the pushrod 108 to close the microswitch 110 and enables the electronic firing circuitry described above. Further, as best seen in FIG. 10, the first surface 114 is positioned so that it no longer blocks movement of the main sear 102 and auxiliary sear 104, but rather stops movement of the auxiliary sear 104 after a limited distance. When a user engages the trigger 16, the trigger 16 contacts and closes microswitch 44 and the electronic circuitry causes the solenoid 48 to operate the main sear 102 and fire the weapon. The first surface 114 does not allow the auxiliary sear 104, and therefore the trigger 16, to rotate sufficiently to mechanically operate the main sear 102.

Figure 11:
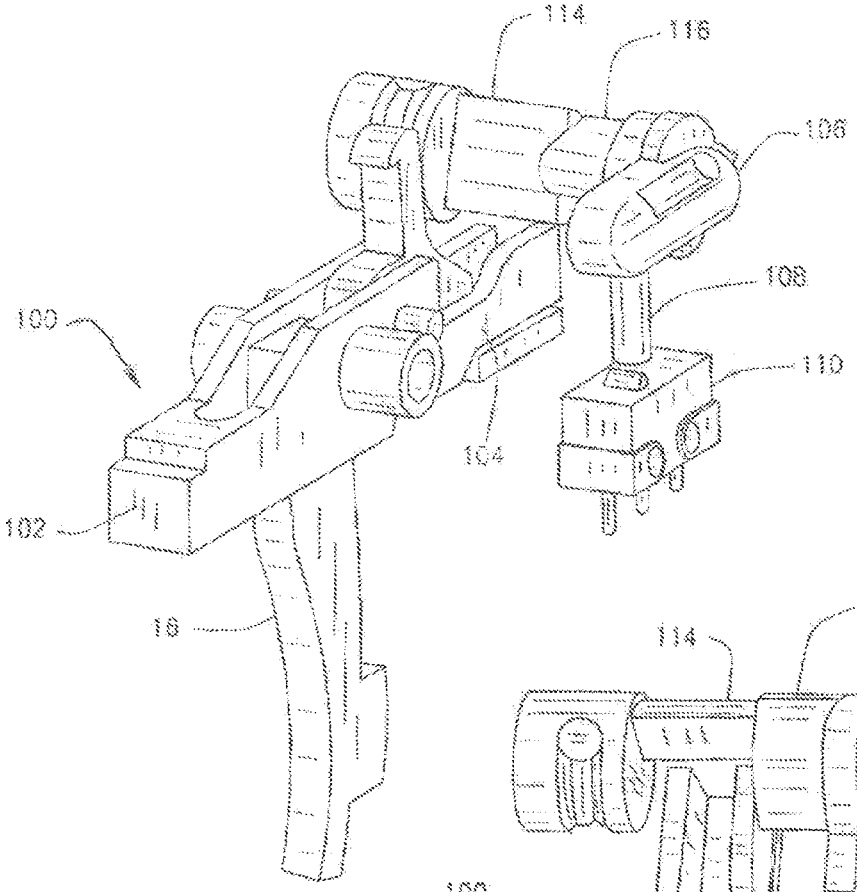
FIG. 11 is a front perspective view of a trigger assembly according to a second embodiment of the invention with the switch in a third position.
Figure 12:
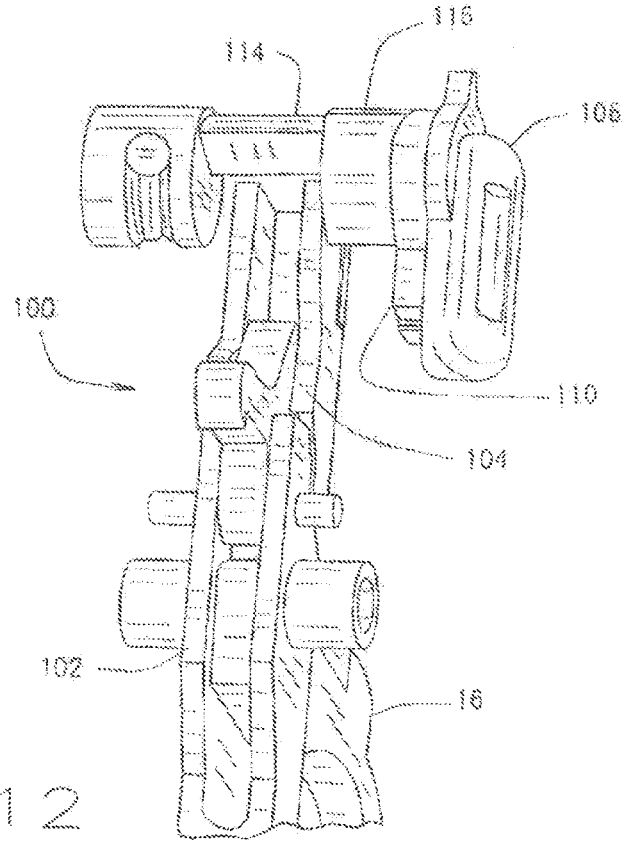
FIG. 12 is a top perspective view of a trigger assembly according to a second embodiment of the invention with the switch in a third position.

In position 3 (FIGS. 11 and 12), the switch 106 is rotated so the weapon is in the mechanical fire mode. In this position, the second cam 116 surface disengages the pushrod 108 to open the microswitch 110 and disables the electronic firing circuitry described above. Further, as best seen in FIG. 12, the first surface 114 is positioned so that it no longer blocks full auxiliary sear 104 as in position 2. When a user engages the trigger 16, the trigger 16 moves the auxiliary sear and the main sear 102 to mechanically fire the weapon. The first surface 114 does not block full movement of the auxiliary sear 104.

What is claimed is:

1. A firearm, comprising:

a hammer rotatably mounted to a lower receiver, the hammer including an engagement surface;

a main sear mounted to the lower receiver and a trigger rotatably mounted to the main sear about a trigger pin, the main sear including an engagement surface that releasably engages the engagement surface of the hammer to prevent the hammer from rotating to fire the firearm;

a secondary sear rotatably mounted to the main sear so that in a mechanical firing mode a pull of the trigger moves the main sear and the secondary sear to disengage the main sear from the engagement surface of the hammer to allow the hammer to rotate to fire the firearm;

a first switch and an electronic circuit electrically connected to the first switch such that a pull of the trigger closes the electronic circuit in an electronic firing mode;

a second switch that activates the electronic circuit;

a selector switch rotatably mounted to the firearm above the main sear and the secondary sear, the selector switch including a first cam surface selectively engageable to at least one of the main sear and the secondary sear and a second cam surface selectively engageable to the second switch, the selector switch being movable between a safety position, an electronic firing mode position, and a mechanical firing mode position, wherein:

in the safety position the first cam surface is positioned to block movement of the main sear and the secondary sear, and the second cam surface is positioned to turn off the electronic circuit with the second switch;

in the electronic firing mode position the second cam surface is positioned to turn on the electronic circuit with the second switch to enable the trigger to activate the electronic circuit, and the first cam surface is positioned to allow limited movement of the main sear and the secondary sear in response to engagement of the main sear by an electronically controlled actuator activated through the electronic circuit by the pull of the trigger to disengage the engagement surface of the main sear from the engagement surface of the hammer so the hammer rotates to fire the firearm; and in the mechanical firing mode position the second cam surface is positioned to turn off the second switch and the first cam surface is positioned to allow the pull of the trigger to move the main sear and the secondary sear to disengage the main sear from the engagement surface of the hammer to allow the hammer to rotate to fire the firearm.

2. The firearm of claim 1, wherein in the electronic firing mode the electronic circuit operates a solenoid in response to the pull of the trigger and the solenoid moves the actuator.

3. The firearm of claim 2, wherein the solenoid moves the actuator toward the main sear to rotate the main sear about the trigger pin.

4. The firearm of claim 1, further comprising a pushrod between the second switch and the second cam surface.

5. The firearm of claim 4, wherein the pushrod is reciprocally moveable by the second cam surface into and out of engagement with the second switch.

6. The firearm of claim 1, wherein the hammer is rotatably mounted to the lower receiver with a hammer pin.

7. The firearm of claim 1, wherein the trigger includes a switch actuator attached thereto that is flexible and deflects when contacting the first switch to accommodate further movement of the trigger.

8. A firearm, comprising:

a hammer rotatably mounted to a lower receiver, the hammer including an engagement surface;

a trigger rotatably mounted to a sear assembly, the sear assembly being mounted to the lower receiver and comprising a main sear and an auxiliary sear rotatably attached to the main sear, wherein the main sear is rotatable relative to the trigger about a trigger pin, the main sear including an engagement surface that engages the engagement surface of the hammer to prevent the hammer from firing the firearm;

a first switch electronically connected to an electronic circuit, the first switch being actuated by a pull of the trigger;

a second switch that activates the electronic circuit;

a selector switch adapted to be rotated to a plurality of positions, wherein a first position comprises a safety mode, a second position comprises an electronic mode of fire and a third position comprises a mechanical mode of fire, wherein:

in the first position the selector switch is positioned to block movement of the main sear and the auxiliary sear and to turn off the electronic circuit with the second switch;

in the second position the selector switch is positioned to turn on the electronic circuit with the second switch and enable the pull of the trigger to activate the electronic circuit, wherein the main sear and the auxiliary sear are movable in response to the pull of the trigger by engagement of the main sear with an electronically controlled actuator activated through the electronic circuit by the pull of the trigger to disengage the engagement surface of the main sear from the engagement surface of the hammer so the hammer rotates to fire the firearm; and in the third position the selector switch is positioned to turn off the electronic circuit with the second switch and to allow the pull of the trigger to move the main sear and the secondary sear to disengage the main sear from the engagement surface of the hammer to allow the hammer to rotate to fire the firearm.

9. The firearm of claim 8, wherein the hammer is rotatably mounted to the lower receiver with a hammer pin.

10. The firearm of claim 8, wherein the selector switch comprises a first cam surface and a second cam surface.

11. The firearm of claim 10, further comprising a pushrod that is contacted by the second cam surface to contact the pushrod with the second switch when the selector switch is located in the second position to turn on the electronic circuit, the push rod being reciprocally moveable to release the second switch in the first and third positions to turn off the electronic circuit.

12. The firearm of claim 11, wherein with the selector switch in the first position the first cam surface blocks movement of the sear assembly.

13. The firearm of claim 12, wherein with the selector switch in the third position the first cam surface is positioned to allow movement of the sear assembly.

14. The firearm of claim 10, wherein with the selector switch in the first position the first cam surface blocks movement of the sear assembly.

15. The firearm of claim 10, wherein with the selector switch in the third position the first cam surface is positioned to allow movement of the sear assembly.

* * * * *